US006457498B1

(12) United States Patent
Salus et al.

(10) Patent No.: US 6,457,498 B1
(45) Date of Patent: Oct. 1, 2002

(54) COSMETIC EYE AND LIP PENCIL SHARPENER

(76) Inventors: Judith A. Salus, 1473 Eyrie Crest Cove, Cordova, TN (US) 38018; Linda Warner, 9025 Prospect Ave., #224, Santee, CA (US) 92071

( * ) Notice: Subject to any disclaimer, the term of this patent is extended or adjusted under 35 U.S.C. 154(b) by 0 days.

(21) Appl. No.: 09/638,448

(22) Filed: Aug. 14, 2000

(51) Int. Cl.[7] ..... B43L 23/60

(52) U.S. Cl. ..... 144/28.1; 30/453; 30/454; 144/28.72

(58) Field of Search ..... 30/451, 452, 453, 30/454; 144/28.1, 28.5, 28.7, 28.72, 30; D19/73, 65

(56) References Cited

U.S. PATENT DOCUMENTS 4,402,354 A * 9/1983 Halpern ..... 30/452
4,966,208 A * 10/1990 Uang ..... 144/28.72
5,077,903 A * 1/1992 Kreim ..... 144/28.1 X
5,875,555 A * 3/1999 Andrisin, III et al. ..... 30/452

* cited by examiner

*Primary Examiner*—W. Donald Bray
(74) *Attorney, Agent, or Firm*—Joseph N. Breaux

(57) ABSTRACT

A cosmetic eye and lip pencil sharpener that includes an electrically powered sharpener for a number of different diameters of cosmetic pencils and which further includes a number of storage cavities for storing cosmetic pencils when they are not being used. In order to facilitate removal of the pencil shavings generated from sharpening the cosmetic pencils, the cosmetic eye and lip pencil sharpener also includes a removable pencil shaving capture drawer for capturing the shavings and providing a convenient mechanism for transporting the shavings to a disposal location such as a trash can.

1 Claim, 1 Drawing Sheet

COSMETIC EYE AND LIP PENCIL SHARPENER

TECHNICAL FIELD

The present invention relates to cosmetic accessories and more particularly to a cosmetic eye and lip pencil sharpener that includes a molded sharpener housing having four suction cup feet extending from a bottom surface thereof, a battery power pack compartment formed into a back surface thereof, an AC/DC adapter/battery recharger assembly in connection with a battery power pack positioned within the battery power pack compartment, and a pop-up housing portion moveably connected with a top surface of the molded sharpener housing having an electrically powered sharpener assembly installed therein having three graduated sized pencil sharpener insertion holes for each for receiving the end of a different diameter cosmetic pencil to be sharpened, each sharpener insertion hole being positioned adjacent a sharpener blade mechanism of the electrically powered sharpener assembly; the pop-up housing portion being spring-loaded and pushed down into a locked position for storage; the electrically powered sharpener assembly being powered by the battery power pack; the molded sharpener housing further including a number of spaced pencil storage cavities formed into a top surface thereof and a removable pencil shaving capture drawer positioned beneath the electrically driven pencil sharpener such that shaving from pencils being sharpened are deposited within a shaving capture compartment of the pencil shaving capture drawer; the electrically driven pencil sharpener being activated by insertion of a pencil into one of the three graduated sized pencil sharpener insertion holes.

BACKGROUND ART

The application of makeup can require the use of a number of cosmetic eye and lip pencils. To obtain the desired effect from these cosmetic pencils it is often necessary that they have a sharp point. This sharp point is typically created by sharpening with the edge of a sharp blade or the use of a conventional hand type pencil sharpener. This can be time consuming and can break the concentration of the makeup artist or the like from his/her work and, thereby, result in poorly applied makeup. It would be a benefit, therefore, to have a cosmetic eye and lip pencil sharpener that including an electrically powered sharpener for a number of different diameters of cosmetic pencils and which further included a number of storage cavities for storing cosmetic pencils when they are not being used. In order to facilitate removal of the pencil shavings generated from sharpening the cosmetic pencils, it would be a further benefit to have a cosmetic eye and lip pencil sharpener that also included a removable pencil shaving capture drawer for capturing the shavings and providing a convenient mechanism for transporting the shavings to a disposal location such as a trash can.

GENERAL SUMMARY DISCUSSION OF INVENTION

It is thus an object of the invention to provide a cosmetic eye and lip pencil sharpener that includes a molded sharpener housing having four suction cup feet extending from a bottom surface thereof, a battery power pack compartment formed into a back surface thereof, an AC/DC adapter/battery recharger assembly in connection with a battery power pack positioned within the battery power pack compartment, and a pop-up housing portion moveably connected with a top surface of the molded sharpener housing having an electrically powered sharpener assembly installed therein having three graduated sized pencil sharpener insertion holes for each for receiving the end of a different diameter cosmetic pencil to be sharpened, each sharpener insertion hole being positioned adjacent a sharpener blade mechanism of the electrically powered sharpener assembly; the pop-up housing portion being spring-loaded and pushed down into a locked position for storage; the electrically powered sharpener assembly being powered by the battery power pack; the molded sharpener housing further including a number of spaced pencil storage cavities formed into a top surface thereof and a removable pencil shaving capture drawer positioned beneath the electrically driven pencil sharpener such that shaving from pencils being sharpened are deposited within a shaving capture compartment of the pencil shaving capture drawer; the electrically driven pencil sharpener being activated by insertion of a pencil into one of the three graduated sized pencil sharpener insertion holes.

Accordingly, a cosmetic eye and lip pencil sharpener is provided. The cosmetic eye and lip pencil sharpener includes a molded sharpener housing having four suction cup feet extending from a bottom surface thereof, a battery power pack compartment formed into a back surface thereof, an AC/DC adapter/battery recharger assembly in connection with a battery power pack positioned within the battery power pack compartment, and a pop-up housing portion moveably connected with a top surface of the molded sharpener housing having an electrically powered sharpener assembly installed therein having three graduated sized pencil sharpener insertion holes for each for receiving the end of a different diameter cosmetic pencil to be sharpened, each sharpener insertion hole being positioned adjacent a sharpener blade mechanism of the electrically powered sharpener assembly; the pop-up housing portion being spring-loaded and pushed down into a locked position for storage; the electrically powered sharpener assembly being powered by the battery power pack; the molded sharpener housing further including a number of spaced pencil storage cavities formed into a top surface thereof and a removable pencil shaving capture drawer positioned beneath the electrically driven pencil sharpener such that shaving from pencils being sharpened are deposited within a shaving capture compartment of the pencil shaving capture drawer; the electrically driven pencil sharpener being activated by insertion of a pencil into one of the three graduated sized pencil sharpener insertion holes.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
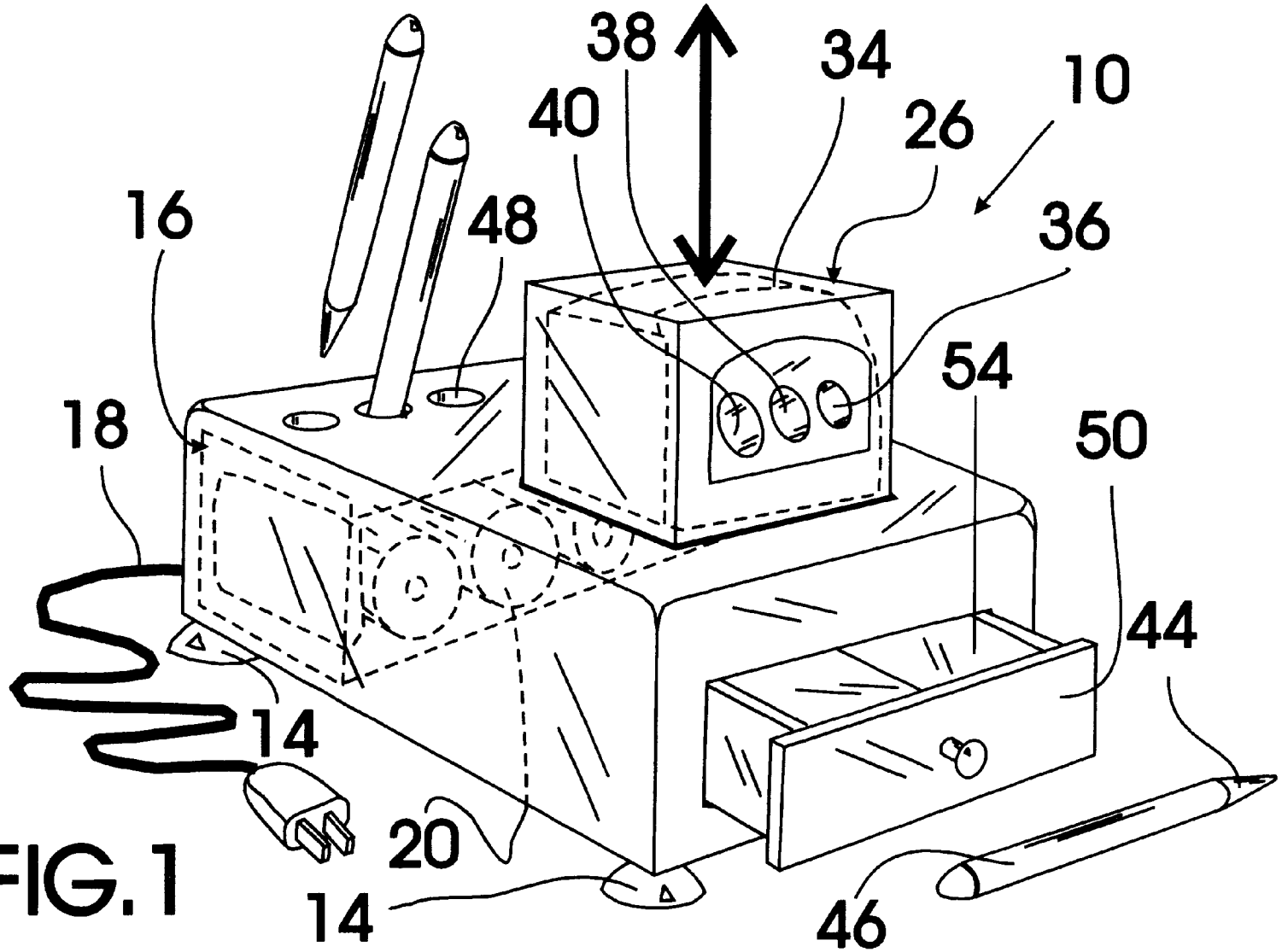
FIG. 1 is a perspective view showing an exemplary embodiment of the cosmetic eye and lip pencil sharpener of the present invention showing the molded sharpener housing having four suction cup feet extending from a bottom surface thereof, a battery power pack compartment formed into a back surface thereof, an AC/DC adapter/battery recharger assembly in connection with a battery power pack positioned within the battery power pack compartment, and a pop-up housing portion moveably connected with a top surface of the molded sharpener housing having an electrically powered sharpener assembly installed therein having three graduated sized pencil sharpener insertion holes for each for receiving the end of a different diameter cosmetic pencil to be sharpened, each sharpener insertion hole being positioned adjacent a sharpener blade mechanism of the electrically powered sharpener assembly; the pop-up housing portion being spring-loaded and pushed down into a locked position for storage; the electrically powered sharpener assembly being powered by the battery power pack; the molded sharpener housing further including a number of spaced pencil storage cavities formed into a top surface thereof and a removable pencil shaving capture drawer positioned beneath the electrically driven pencil sharpener such that shaving from pencils being sharpened are deposited within a shaving capture compartment of the pencil shaving capture drawer; the electrically driven pencil sharpener being activated by insertion of a pencil into one of the three graduated sized pencil sharpener insertion holes.

FIG. 1 shows an exemplary embodiment of the cosmetic eye and lip pencil sharpener of the present invention generally designated 10. Cosmetic eye and lip pencil sharpener 10 includes a molded sharpener housing, generally designated 12, having four suction cup feet 14 extending from a bottom surface thereof, a battery power pack compartment, generally designated 16 (shown in dashed lines), formed into a back surface thereof, an AC/DC adapter/battery recharger assembly 18 in connection with a battery power pack 20 (Shown in dashed lines) positioned within battery power pack compartment 16, and a pop-up housing portion, generally designated 26 moveably connected with a top surface 28 of molded sharpener housing 12 having an electrically powered sharpener assembly, generally designated 34 (shown in dashed lines) installed therein having three graduated sized pencil sharpener insertion holes 36,38, 40, each for receiving the end 44 of a different diameter cosmetic pencil 46 to be sharpened. Each sharpener insertion hole 36,38,40 is positioned adjacent a sharpener blade mechanism of electrically powered sharpener assembly 34. Pop-up housing portion 26 is spring-loaded and pushed down into a locked position for storage. Electrically powered sharpener assembly 34 is powered by battery power pack 20. Molded sharpener housing 12 also includes a number of spaced pencil storage cavities 48 formed into top surface 28 thereof and a removable pencil shaving capture drawer 50 positioned beneath electrically driven pencil sharpener 34 such that shaving from pencils 46 being sharpened are deposited within a shaving capture compartment 54 of pencil shaving capture drawer 50. Electrically driven pencil sharpener 34 is activated by insertion of a pencil 46 into any one of the three graduated sized pencil sharpener insertion holes 36,38,40.

It can be seen from the preceding description that a cosmetic eye and lip pencil sharpener has been provided.

It is noted that the embodiment of the cosmetic eye and lip pencil sharpener described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A cosmetic eye and lip pencil sharpener comprising:

a molded sharpener housing having four suction cup feet extending from a bottom surface thereof;

a battery power pack compartment formed into a back surface thereof;

an AC/DC adapter/battery recharger assembly in connection with a battery power pack positioned within the battery power pack compartment; and a pop-up housing portion moveably connected with a top surface of the molded sharpener housing having an electrically powered sharpener assembly installed therein having three graduated sized pencil sharpener insertion holes for each for receiving the end of a different diameter cosmetic pencil to be sharpened, each sharpener insertion hole being positioned adjacent a sharpener blade mechanism of the electrically powered sharpener assembly;

the electrically powered sharpener assembly being powered by the battery power pack;

the molded sharpener housing further including a number of spaced pencil storage cavities formed into a top surface thereof and a removable pencil shaving capture drawer positioned beneath the electrically driven pencil sharpener such that shaving from pencils being sharpened are deposited within a shaving capture compartment of the pencil shaving capture drawer;

the electrically driven pencil sharpener being activated by insertion of a pencil into one of the three graduated sized pencil sharpener insertion holes.

* * * * *